United States Patent [19]

Wilson

[11] 4,270,829

[45] Jun. 2, 1981

[54] JUMPER SOCKET

[75] Inventor: Albert H. Wilson, Los Angeles, Calif.

[73] Assignee: Thomas & Betts Corporation, Raritan, N.J.

[21] Appl. No.: 70,436

[22] Filed: Aug. 28, 1979

[51] Int. Cl.[3] ..... H01R 13/115

[52] U.S. Cl. ..... 339/96; 339/17 C; 339/258 R; 339/275 B

[58] Field of Search ..... 339/276 SF, 258 R, 258 P, 339/17 R, 17 C, 275 B, 96 R

[56] References Cited

U.S. PATENT DOCUMENTS

| | | | |
|---|---|---|---|
| 2,894,240 | 7/1959 | Mautner | 339/17 |
| 3,160,790 | 12/1964 | Mittler | 317/101 |
| 3,391,375 | 7/1968 | Richards | 339/17 |
| 3,696,323 | 10/1972 | Kinkaid et al. | 339/17 C |
| 3,721,944 | 3/1973 | Weidler | 339/19 |
| 3,768,068 | 10/1973 | Palecek | 339/258 P |
| 3,777,285 | 12/1973 | Barr | 339/17 CF |
| 3,818,423 | 6/1974 | McDonough | 339/258 P |
| 3,850,500 | 11/1974 | Cobaugh et al. | 339/258 R |
| 3,875,479 | 4/1975 | Jaggar | 317/101 CM |
| 4,030,793 | 6/1977 | Hanlon et al. | 339/19 |

*Primary Examiner*—John McQuade

*Attorney, Agent, or Firm*—Robert M. Rodrick; Jesse Woldman

[57] ABSTRACT

A socket for a printed circuit board to permit the selective connection and disconnection of jumper cables from such boards. The socket has a tail portion for insertion into a plated through hole in a board and attachment to the underside thereof. Two spaced apart, generally parallel arms provide a cavity for the selectively releasable receipt of a jumper conductor. Each arm has an inwardly directed intermediate portion and an outwardly directed distal end to aid in inserting the conductor into the cavity and preventing its unwanted withdrawal. A downturned end of the inturned opposite end of one of the arms cooperates with the base to position the socket and maintain its stability.

9 Claims, 10 Drawing Figures

JUMPER SOCKET

BACKGROUND OF THE INVENTION

1. Field of the Invention

This invention relates to the interconnection of electronic components on printed circuit boards and more particularly to the joining of jumper cables to such printed circuit boards.

2. Description of the Prior Art

In the prior art when a jumper cable was to be employed to join two printed circuit boards, sockets of the type shown in U.S. Pat. No. 3,902,153 issued Aug. 26, 1975, entitled "Circuit Board Socket" by Ronald S. Narozny and assigned to the assignee of the instant invention, were inserted in the plated through apertures in the boards and welded or soldered thereto. The bared ends of the jumpers were next inserted into the sockets, one conductor for each socket, and soldered thereto. This resulted in a permanent joint not easily separated as in the field when printed circuit boards were to be changed. Other techniques required the direct bonding of the ends of the individual conductors of the jumpers to the conductive pads of the printed circuit boards.

SUMMARY OF THE INVENTION

The present invention overcomes the difficulties noted above with respect to prior art techniques by providing a means whereby the conductors of a jumper can be selectively coupled to or removed from engagement with portions of a printed circuit board. A socket is formed with an extended tail portion for insertion into a plated through hole in a printed circuit board and once so inserted is welded or soldered in place to the printed circuit board underside. Two spaced apart, generally parallel arms provide a cavity therebetween for the selective receipt, selectively releasable engagement between such arms and a conductor of a jumper. Each arm is inwardly directed at an intermediate portion to limit conductor removal from the cavity and outwardly directed at the free end to facilitate entry of a conductor between the arms into the cavity. A downturned end of the inturned opposite end of one of the arms cooperates with the base to position the socket on the printed circuit board and maintain its stability. A film material is applied between the printed circuit board and the socket, pierced by the sharpened tail of the socket as it is inserted into the hole to form a barrier to prevent the wicking of the solder used to join the socket to the board, into the socket to interfere with its operation. It is an object of this invention to provide a printed circuit board socket.

It is a further object of this invention to provide a printed circuit board socket to permit the detachable coupling of conductors to a printed circuit board.

It is a further object of this invention to provide a printed circuit board socket to permit the detachable coupling of round or formed conductors to a printed circuit board.

It is still a further object of this invention to provide a printed circuit board socket to permit the selective coupling or uncoupling of conductors of a jumper to a printed circuit board.

Other objects and features of the invention will be pointed out in the following descriptions and claims and illustrated in the accompanying drawings, which disclose, by way of example, the principles of the invention, and the best modes which have been contemplated for carrying them out.

BRIEF DESCRIPTION OF THE DRAWINGS

In the drawings in which similar elements are given similar reference characters.

DESCRIPTION OF THE PREFERRED EMBODIMENT

Figure 1:
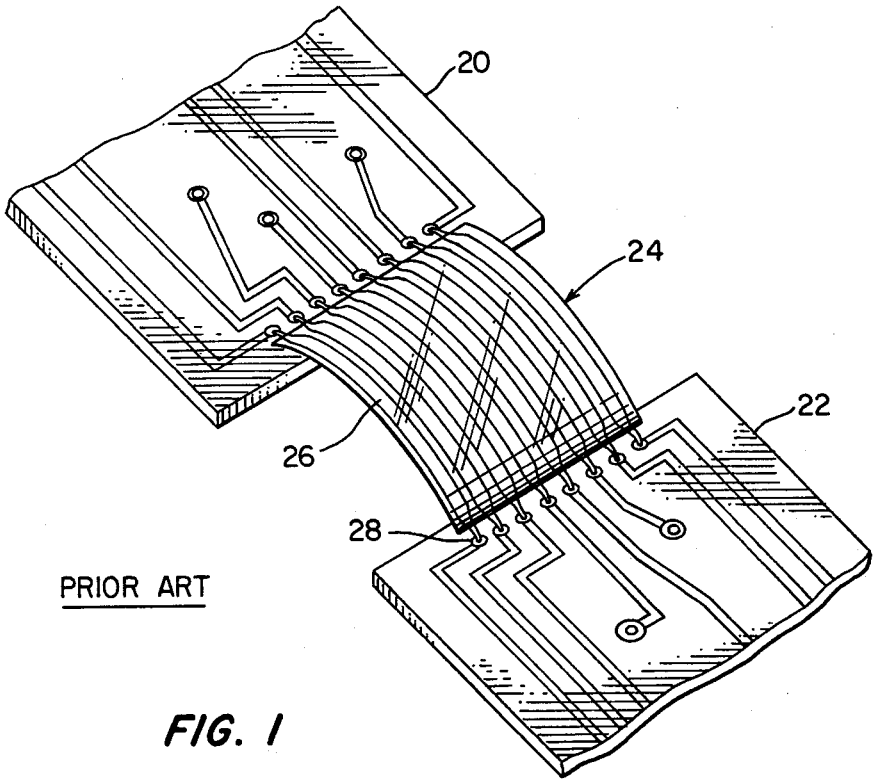
FIG. 1 is a perspective view of two printed circuit boards connected by jumpers according to the prior art.
Figure 2:
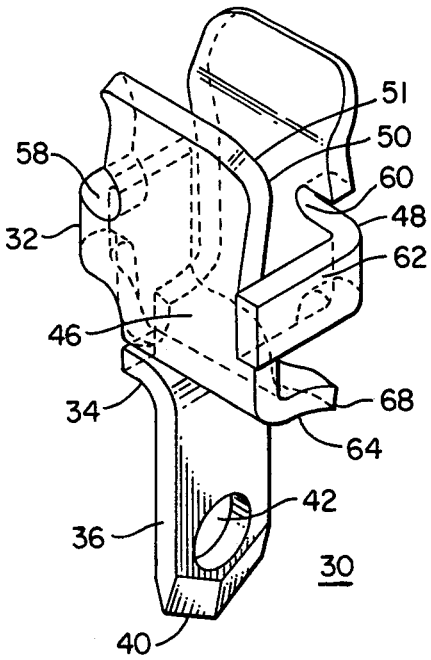
FIG. 2 is a perspective view of a socket constructed in accordance with the concepts of the invention.

FIG. 1 is a view of a typical prior art coupling between two printed circuit boards 20, 22 respectively, employing a multiconductor jumper 24. Each of the individual conductors 26 of the jumper 24 will enter corresponding plated-through holes 28 on the respective printed circuit boards and be soldered to the undersides to prevent separation of the jumper 24 from the boards 20, 22 respectively. If it is necessary to change either of the boards 20, 22 or to replace the jumper 24, then it is necessary to unsolder the individual conductors 26 from the boards 20, 22 respectively without damaging any of these elements. Such facilities were often not available in a field-type situation and were time-consuming and presented a high likelihood of damage.

Figure 3:
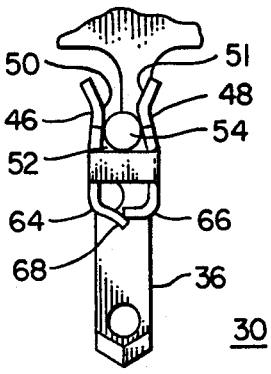
FIG. 3 is a front elevational view of the socket of FIG. 2 with a conductor having a circular cross-section inserted therein.
Figure 4:
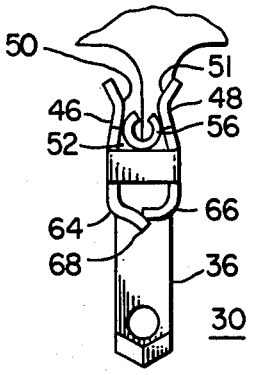
FIG. 4 is a front elevational view of the socket of FIG. 2 with a formed conductor inserted therein.
Figure 5:
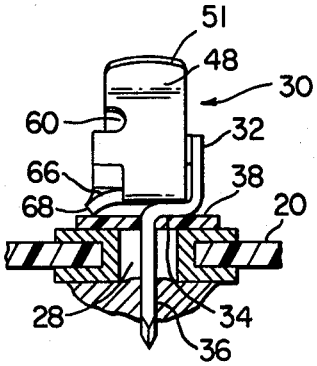
FIG. 5 is a side elevational view of the socket of FIG. 2 inserted into a printed circuit board.
Figure 6:
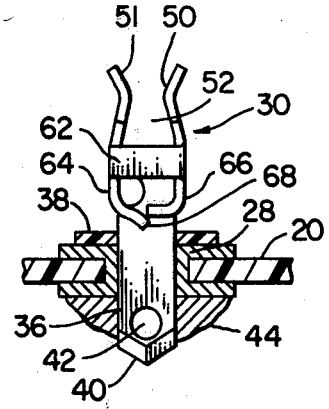
FIG. 6 is a front elevational view, partially in section, of the socket of FIG. 2 inserted into a printed circuit board.

Referring now to FIGS. 2 to 6, there is shown socket 30 constructed in accordance with the concepts of the invention. The socket 30 has a back portion 32 extending perpendicularly to the plane of a printed circuit board 20 (see FIG. 5) and a base portion 34 formed at the transition of the back portion 32 into the extended tail portion 36. Base portion 34 supports the socket 30 upon the surface of the printed circuit board 20 directly, or, if employed, upon a wicking prevention strip 38 intruded between base portion 34 and the surface of the printed circuit board 20, as shown in FIG. 5.

The wicking prevention strip 38 prevents solder being used to anchor the socket 30 at the underside of the printed circuit board 20 from passing by capillary action, through the plated-through hole 28, in which tail portion 36 is placed, and along the tail portion 36 to the conductor receiving cavity to block such cavity. The strip 38 may be nylon, or other material as can withstand the solder heat without deterioration and which can be easily pierced by the sharpened edges 40 of the tail portion 36. An aperture 42 extends through the tail portion 36 to accept solder 44 (see FIG. 6) therein to provide a nonrotatable, non-removable joint between the socket 30 and the printed circuit board 20. If desired, the socket can be spaced apart from the surface of the printed circuit board and tail portion fitted with circular or triangular or split ring detail to fit within the holes 28. Also, an antiwicking barrier can be placed upon any extended tail portion to prevent the solder from travelling up the tail portion into the socket. Stiffeners, etc. may be employed to prevent undue bending of any extended tail portion.

Extending from back portion 32 in spaced apart, generally parallel planes are arms 46, 48 respectively. Intermediate the ends thereof, the arms 46, 48 inwardly converge to define a restriction 50 to the cavity 52 defined by the lower portions of the arms 46, 48. It is within this cavity 52 that conductors of the jumper can be received. The shape of the cavity 52 permits the receipt of round conductors 54, as is shown in FIG. 3, and found in jumpers of the type constructed in accordance with U.S. Pat. No. 3,601,755 to James Shiells issued Aug. 24, 1971 entitled "Electrical Jumper and Method of Making Same" and assigned to the assignee of the instant invention or formed conductors 56, as is shown in FIG. 4, and found in jumpers of the type constructed in accordance with U.S. Pat. No. 3,997,229 to Dennis Bossi and Ronald S. Narozny issued Dec. 14, 1976 entitled "Flexible Strip Jumpers" and assigned to the assignee of the instant invention. The restriction 50 prevents the unwanted withdrawal of the conductors 54 or 56 from cavity 52 while permitting such withdrawal when desired.

The material from which the socket 30 is constructed, such as copper or copper alloys, such as beryllium copper gives the arms 46, 48 flexibility which is improved by the slots 58, 60, respectively which decrease the width of the connecting webs. To facilitate the entry of conductors 54, 56 into cavity 52 the free ends of the arms 46, 48 are outwardly directed, as at 51, from the restriction 50. A strengthening tab 62 extends from arm 48 to arm 46 to make the socket 30 more rigid and to define the lower limit of the cavity 52. Further strengthening of the socket 30 is achieved by the engagement of the inturned other ends 64, 66 of the arms 46, 48 respectively. The leading edge of the inturned end 64 is also downturned as at 68 to provide a front line of contact between the printed circuit board 20 and socket 30, as in clear in FIG. 5.

Figure 7:
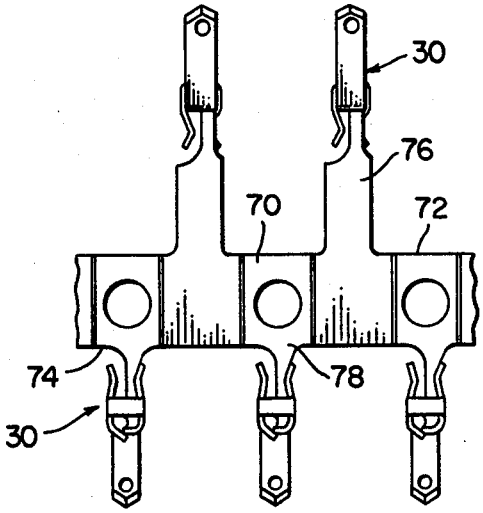
FIG. 7 is a front elevational view of the socket in strip form.
Figure 8:
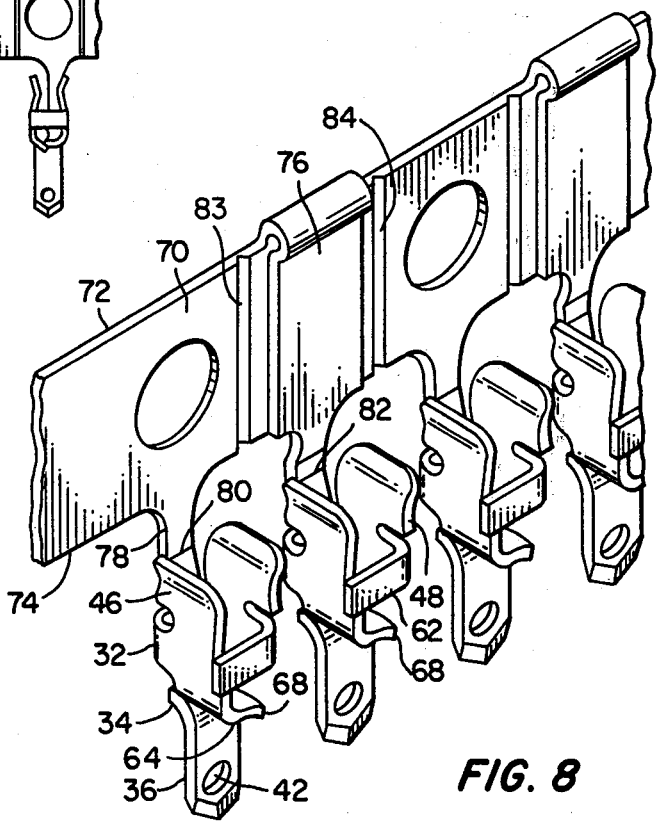
FIG. 8 is a perspective view of the socket in strip form with the sockets in fully formed condition.

Turning now to FIGS. 7 and 8, the method by which the sockets 30 of FIGS. 2 to 6 are manufactured can be better appreciated. The sockets 30 are formed along both edges 72, 74 respectively of a carrier strip 70. The sockets 30 formed along edge 72 are formed on a long extension 76 which permits the socket 30 thereon to be positioned between adjacent sockets 30 formed along edge 74 and connected to strip 70 by a short extension 78. In this manner, all of the material needed to form the socket 30 is available and the spacing between adjacent sockets can be reduced from that possible if all sockets were formed along edge 74. The carrier strip 70 acts to support the sockets 30 as they are inserted in the plated-through holes 28 of printed circuit board 20, (the spacing between the sockets 30 on strip 70 being the same as the spacing between the holes 28) and until the soldering operation is complete. The carrier also serves as a heat sink for hand soldering on printed circuit boards without the anti-wick strip 38 to inhibit solder flow into cavity 52. The carrier strip 70 is separated from the sockets 30 by breaking along the break lines 80, 82 on the extensions 78, 76 respectively. Break lines 83, 84 (see FIG. 8) allow carrier to be broken at any number of sockets without cutting.

Figure 9:
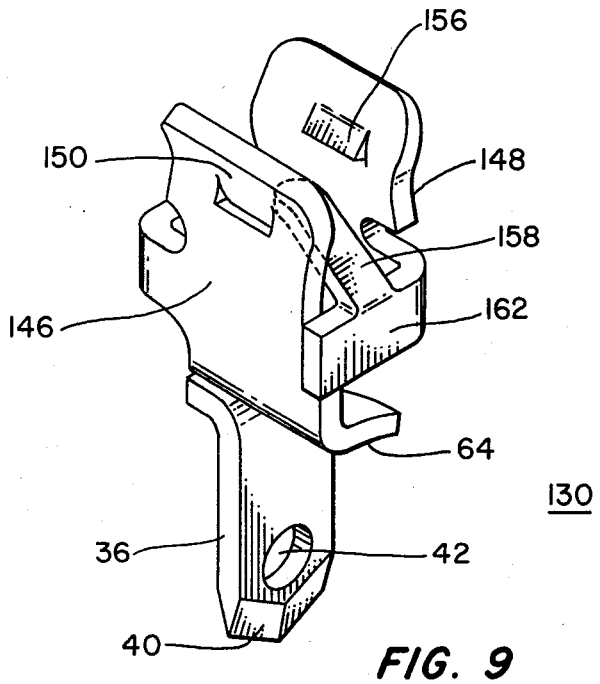
FIG. 9 is a perspective view of a further socket constructed in accordance with the concepts of the invention.
Figure 10:
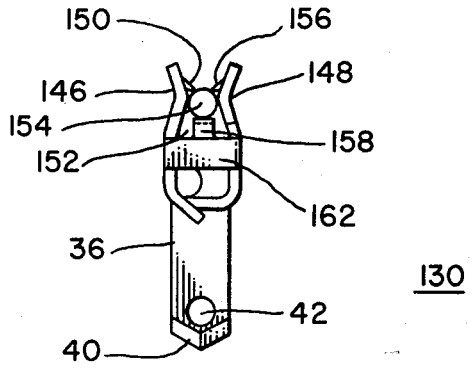
FIG. 10 is a front elevational view of the socket of FIG. 9 with a conductor inserted therein.

FIGS. 9 and 10 show a modification of the socket of FIGS. 2 to 6, particularly useful where the joint is subject to severe vibration. The arms 146, 148 of socket 130 are lanced as at 150 and 156 respectively with the free ends of such lances directed inwardly into the cavity 152 to engage the circular conductor 154 placed therein. A cantilever-mounted extension 162 projects from strengthening tab 162 into cavity 152 to also engage the conductor 154 in cavity 152. In practice, the spacing between the free ends of the extension 162 and the lances 150 and 156 is smaller than the diameter of the conductor 154 to be placed in cavity 152. The entering conductor 154 spreads the arms 146, 148 and depresses the extension 162. The natural resilience of the extension 162 forces the conductor 154 up against the free ends of the lances 150, 156 and thus assures a solid three-point contact of the conductor 154.

While there have been shown and described and pointed out the fundamental novel features of the invention as applied to the preferred embodiments, it will be understood that various omissions and substitutions and changes of the form and details of the devices illustrated and in their operation may be made by those skilled in the art, without departing from the spirit of the invention.

The embodiments of the invention in which an exclusive property or privilege is claimed are defined as follows:

1. A circuit board socket comprising in combination: a base member; a tail member coupled to said base member for engagement with the defining walls of a plated-through aperture in a circuit board; and a pair of upstanding, generally parallel spaced apart arm members coupled to said base member for receipt therebetween of an electrical conductor to provide an electrically continuous path between such electrical conductor and a circuit board, said arm members having first free ends outwardly directed to aid in the insertion of an electrical conductor between said arm members, second free ends of said arm members being inwardly directed to engage one another to limit any separation of said arm members as an electrical conductor is inserted therebetween, said arm members being inwardly directed intermediate said ends thereof to provide a restriction to limit the withdrawl of an electrical conductor inserted therebetween.

2. A circuit board socket as claimed in claim 1, wherein said tail member has an aperture therethrough adjacent its free end to accept a connecting media and secure said socket to a circuit board.

3. A circuit board socket as claimed in claim 1, wherein said tail member has a sharpened free end to permit said tail member to be inserted into a plated-through aperture in a circuit board through an insulating medium placed atop such circuit board.

4. A circuit board socket as claimed in claim 1, wherein said tail member has a sharpened free end to permit said tail member to be inserted into a plated-through aperature in a circuit board through an insulating medium placed atop such circuit board, said tail member having an aperture therethrough adjacent its free end to accept a connecting media and secure said socket to a circuit board.

5. A circuit board socket as claimed in claim 1, wherein said base member extends in a direction along the surface of a circuit board for engagement with such circuit board surface when said socket is seated upon said circuit board.

6. A circuit board socket as claimed in claim 1, where a region adjacent a free end of one of said arm members is inwardly directed and the distal part of such free end is downwardly directed to stabilize said socket in a plated-through aperture in a circuit board.

7. A circuit board socket as claimed in claim 1, wherein a region adjacent a free end of one of said arm members is inwardly directed and the distal part of such free end is downwardly directed, the edge thereof with said base member defining a planar surface.

8. A circuit board socket comprising in combination: a base member; a tail member coupled to said base member for engagement with the defining walls of a plated-through aperture in a circuit board; and a pair of upstanding, generally parallel spaced apart arm members coupled to said base member for receipt therebetween of an electrical conductor to provide an electrically continuous path between such electrical conductor and a circuit board, a lance in each of said arm members, the free ends thereof directed towards said base member; an extension coupled to said base member at a first end and having a second free end directed towards the free ends of said lances to engage an electrical conductor between the free end of said extension and the free ends of said lances.

9. A circuit board socket as claimed in claim 8 wherein said extension is cantilever-mounted to said base member.

* * * * *